US006199629B1

(12) United States Patent
Shirk et al.

(10) Patent No.: US 6,199,629 B1
(45) Date of Patent: Mar. 13, 2001

(54) COMPUTER CONTROLLED DOWNHOLE SAFETY VALVE SYSTEM

(75) Inventors: Steve Shirk, Broken Arrow; Mike Rawson, Tulsa; Brian Shaw, Broken Arrow, all of OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/158,382

(22) Filed: Sep. 22, 1998

Related U.S. Application Data

(60) Provisional application No. 60/059,852, filed on Sep. 24, 1997.

(51) Int. Cl.[7] ..... E21B 34/10; E21B 36/00; E21B 43/12; E21B 47/06

(52) U.S. Cl. ..... 166/66.4; 166/65.1; 166/302

(58) Field of Search ..... 166/65.1, 66.4, 166/302, 304

(56) References Cited

U.S. PATENT DOCUMENTS

| | | | |
|---|---|---|---|
| 3,731,742 | 5/1973 | Sizer et al. | 166/315 |
| 4,062,379 | 12/1977 | Clinton | 137/565 |
| 4,568,933 | 2/1986 | McCracken et al. | 340/856 |
| 4,617,960 | 10/1986 | More | 137/554 |
| 4,621,689 | 11/1986 | Brookbank, III | 166/106 |
| 4,796,708 | 1/1989 | Lembcke | 166/386 |
| 4,798,247 | 1/1989 | Deaton et al. | 166/373 |
| 4,886,114 | 12/1989 | Perkins et al. | 166/65.1 |
| 5,008,664 | 4/1991 | More et al. | 340/854 |
| 5,070,944 | 12/1991 | Hopper | 166/66.4 |
| 5,186,255 | 2/1993 | Corey | 166/250 |
| 5,207,272 | 5/1993 | Pringle et al. | 166/66 |
| 5,226,491 | 7/1993 | Pringle et al. | 166/66.4 |
| 5,230,383 | 7/1993 | Pringle et al. | 166/66.4 |
| 5,236,047 | 8/1993 | Pringle et al. | 166/369 |
| 5,257,663 | 11/1993 | Pringle et al. | 166/66.4 |
| 5,358,035 | 10/1994 | Grudzinski | 166/53 |
| 5,458,200 | 10/1995 | Lagerlef et al. | 166/372 |
| 5,496,044 | 3/1996 | Beall et al. | 277/1 |
| 5,526,883 * | 6/1996 | Breaux | 166/373 |
| 5,597,042 * | 1/1997 | Tubel et al. | 166/250.01 |
| 5,721,538 * | 2/1998 | Tubel et al. | 340/853.4 |
| 5,732,776 * | 3/1998 | Tubel et al. | 166/250.15 |
| 5,803,167 * | 11/1998 | Bussear et al. | 166/65.1 |
| 5,868,201 * | 2/1999 | Bussear et al. | 166/53 |

FOREIGN PATENT DOCUMENTS

| | | |
|---|---|---|
| 2 216 570 | 10/1989 | (GB) . |
| 2 302 114 | 1/1997 | (GB) . |
| 2 302 349 | 1/1997 | (GB) . |

* cited by examiner

*Primary Examiner*—George Suchfield
(74) *Attorney, Agent, or Firm*—Cantor Colburn LLP

(57) ABSTRACT

A subsurface safety device positioning and monitoring system includes a controller and at least one downhole sensor that senses and records conditions of the well near the valve and of the valve itself. Conditions include temperature, pressure, flow rate, degree of closure of valve, structural condition of valve, water cut of produced fluids, etc.

12 Claims, 5 Drawing Sheets

INPUTS

I. INFORMATION ORIGINALLY STORED IN MEMORY

II. INFORMATION PROGRAMMED AT SIDE OPERATING RANGES
SITE SPECIFIC DATA (ENVIRONMENTAL, ETC.)

III. SELF SENSING
FLOW TUBE POSITION
FLAPPER POSITION
FRICTION OF MOVEMENT
POWER REQUIREMENTS
CONTROL SIGNALS

IV. SENSING ENVIRONMENT
TEMPERATURE
DIFFERENTIAL PRESSURE
ACROSS VALVE
ANNULUS PRESSURE
LEAKAGE ACROSS VALVE
TENSION/TORQUE AT VALVE
BENDING MOMENT ON VALVE
CONTAMINATION OF
PRODUCTION FLUID

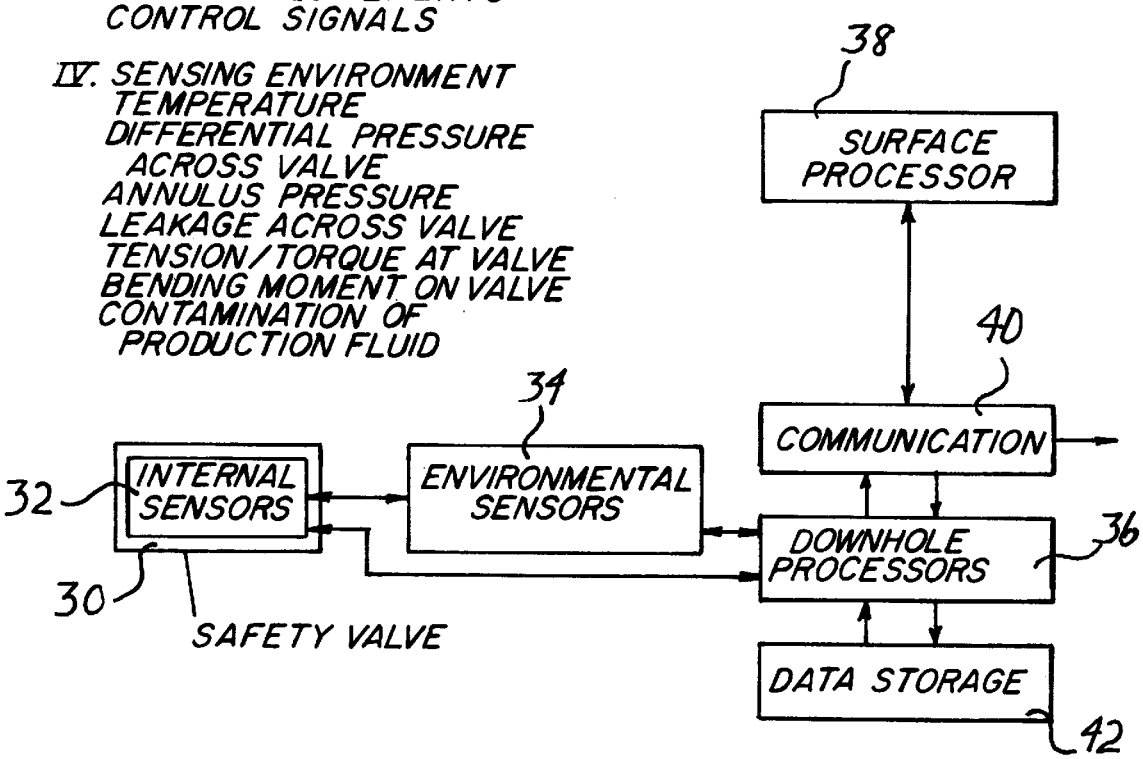

OUTPUTS

I. DECISION MAKING
Actuate/shut down accessory tools
Open/close safety valve

II. COMMUNICATION
COMMUNICATE WITH OTHER TOOLS
COMMUNICATE WITH OTHER WELLS
COMMUNICATE WITH OTHER PLATFORMS

FIG. 4

COMPUTER CONTROLLED DOWNHOLE SAFETY VALVE SYSTEM

CROSS-REFERENCE TO RELATED APPLICATION

This application claims the benefit of an earlier filing date from U.S. Provisional Application No. 60/059,852 filed Sep. 24, 1997.

BACKGROUND OF THE INVENTION

1. Field of the Invention

This invention relates to a computer controlled intelligent downhole safety valve system. More particularly, the invention relates to a preferably electrically but possibly hydraulically, mechanically, electromechanically, electrohydraulically or pneumatically actuated and operated system comprising a safety valve and a plurality of sensors delivering information to and receiving instructions from a processor whether located locally or remotely from the valve.

2. Prior Art

Safety valves have been in existence for some time and have consistently been important to the safety of the environment and hydrocarbon drilling and production personnel.

Traditionally, safety valves have been hydraulically actuated and were operated from the surface based upon information gleaned from the production fluid or based upon dangerous conditions at the surface.

Hydraulically actuated safety valves commonly employ a flapper valve and a flow tube movable axially relative to the flapper valve. Thus, when the tube moves downhole the flapper is pushed open and the tube connects with more production tube downhole. As long as the flow tube remains in this downhole position the flapper stays open. The flow tube is biased however to an uphole position by a relatively high rate coil spring, the urging of which is overcome by hydraulic fluid pressure exerted from a reservoir, usually located at the surface. Necessarily there is a high pressure hydraulic fluid line extending from the reservoir to the valve which may be, for example, six thousand feet below the surface. Due to the large volume of hydraulic fluid that must be moved uphole in this fluid line, closing of the flapper is not as speedy as might be desired. Moreover, safety valves of this type, as stated above, are actuated only when conditions requiring a shut-in are perceptible at the surface.

More recently some work has been done to employ electric power to actuate and control safety valves. U.S. Pat. No. 5,070,944 to Hopper discloses a downhole electrically operated safety valve comprising an electric motor which drives a gear assembly having a drive gear and an operating gear, said gears providing a ratio of 30:1. The gears are operatively connected to a two-part drive sleeve the parts of which rotate together but are capable of relative axial movement. An actuating sleeve is also employed and a solenoid operated releasable lock prevents relative axial movement between the two parts of the drive sleeve.

Even with what may be considered more advanced electrically actuated downhole safety valves, the decision making is made at the surface depending upon information obtained at the surface. This limits the effectiveness of the safety valve because whatever condition indicates to the operator, from evaluation of production fluids, that the valve should close is a condition occurring through perhaps six thousand feet of pipe before the valve is shut. Therefore, there is a significant need for a system capable of obtaining information and rendering decisions downhole as well as being capable of communicating with other downhole tools, the surface and other wells. An example of a computer controlled safety valve and production well control system is disclosed in application Ser. No. 08/599,324 filed Feb. 9, 1996, all of the contents of which are incorporated herein by reference thereto.

SUMMARY OF THE INVENTION

The above-discussed and other drawbacks and deficiencies of the prior art are overcome or alleviated by the several methods and apparatus for providing computerized ("intelligent") systems for operating, monitoring, controlling and diagnosing various parameters of downhole safety valve systems whether hydraulically actuated, hydraulically/electrically actuated or electrically actuated, electrically actuated systems being preferred. The systems disclosed provide the ability for the valve assembly to sense itself, sense its surrounding environment, make decisions and communicate with other downhole systems and surface systems on the same platform or on different platforms. Communication can even be provided between safety valves in different wells.

In order to provide an overview of the computer controlled intelligent systems contemplated in the present invention and their relation to the overall system for advanced hydrocarbon production, attention is directed to FIG. 1 of the application. FIG. 1 illustrates a pelagic situation having three platforms each with multiple lateralated wells and a communication system to provide a real time link between all of the wells. The system illustrated also embodies a number of downhole control systems that communicate downhole information to the surface and can receive information or instructions from the surface and from remote locations in communication with the surface.

In accordance with the present invention, a plurality of sensors are connected to processing units located downhole, uphole or both to provide sufficient input for the processors to carry out previously installed instructions or to develop databases of information collected over time. These data and processing units allow the safety valves of the invention to alter their own operational parameters to account for such time and environmental changes as the buildup of paraffin, scaling, sand etc., in the valve which might otherwise prevent its operation. The invention includes a downhole operated heater to melt and disperse paraffin as well as a current supplying device to remove scaling. These devices greatly enhance and improve longevity and operation of safety valves which, in turn, improves the safety of hydrocarbon production.

Other sensors and sensing arrangements allow intelligent systems to monitor potential problems requiring the alteration of other downhole tools. For example, water in the production fluid can be detected at the safety valve or even therebelow by sensors and therefore allow corrective action taken before the entire production tube to the surface is filled with contaminated production fluid. This enables a faster response and less down time. An example is a system that senses water and communicates with a sliding sleeve in a lateral well further downhole. This communication will trigger other intelligent operations which result in a particular sleeve closing or a group of sleeves closing to shut-in the offending reservoir. Moreover, the safety valve may need to close while the sleeves are moving and then reopen when the sliding sleeves are closed.

Moreover, the intelligent systems at or about the safety valve will more quickly shut-in that valve upon detection of an irregularity that could not have been detected at the surface for a significant period of time depending upon the distance of the tube above the valve. For some situations this will prevent a catastrophic disaster by shutting-in all wells on a platform or in an area by communication from valve to valve, if conditions warrant. Alternatively, the intelligent system of the invention can also understand the severity of any potential problem and communicate to other wells to increase production to make up for the shut-in well. This ability avoids loss of production and revenue.

Examples of sensory perception the safety valves of the invention will have regarding itself include: sensing the flow tube position and/or orientation, sensing the flapper position, sensing the amount of friction during movement of the flow tube or flapper valve and relatively the amount of power required to move these parts (this information is mapped to predict further movement parameters and future failure of the tool) and sensing a control signal (i.e., to ensure that the signal at the valve equals the signal initiated at the surface).

Examples of sensory perception afforded the safety valve of the invention relative to its environment include: Temperature at the valve, differential pressure across the valve, annulus pressure or temperature, leakage across the valve, tension and torque on valve components, bending moment on the valve, contamination of the production fluid by water, etc.

Based upon the information gathered through the sensors utilized in the control system of the invention, downhole or surface processors render decisions about opening or closing valves and setting or actuating other tools. These decisions are based upon preprogrammed operational parameters or upon accumulated sensory information (built databases) and projections made therefrom. The accumulated information also provides information for use in product failure analysis, i.e., was failure due to manufacturing workmanship or due to extreme conditions downhole not known previously.

Decisions made and executed by the system are communicated to many places, as desired, including: sliding sleeves, surface safety systems, E.S.P. systems, gaslift systems, annulus safety valves, etc. whether in the well in which the information is collected or in other wells if necessary.

The computer controller or controllers employed in the system is/are preferably microprocessor type components which are capable of performing all desired tasks without subsequent human intervention or monitoring. It is, of course, possible to provide an associated display device at the surface for manned monitoring, if desired. Where manned monitoring is desired, a keyboard or other similar input device is also available to direct or override decisions made downhole.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGS.:

FIG. 4 is a schematic flowchart representation of the safety valve with sensors, controllers and routing illustrated by arrows.

DETAILED DESCRIPTION OF THE PREFERRED EMBODIMENTS

Figure 1:
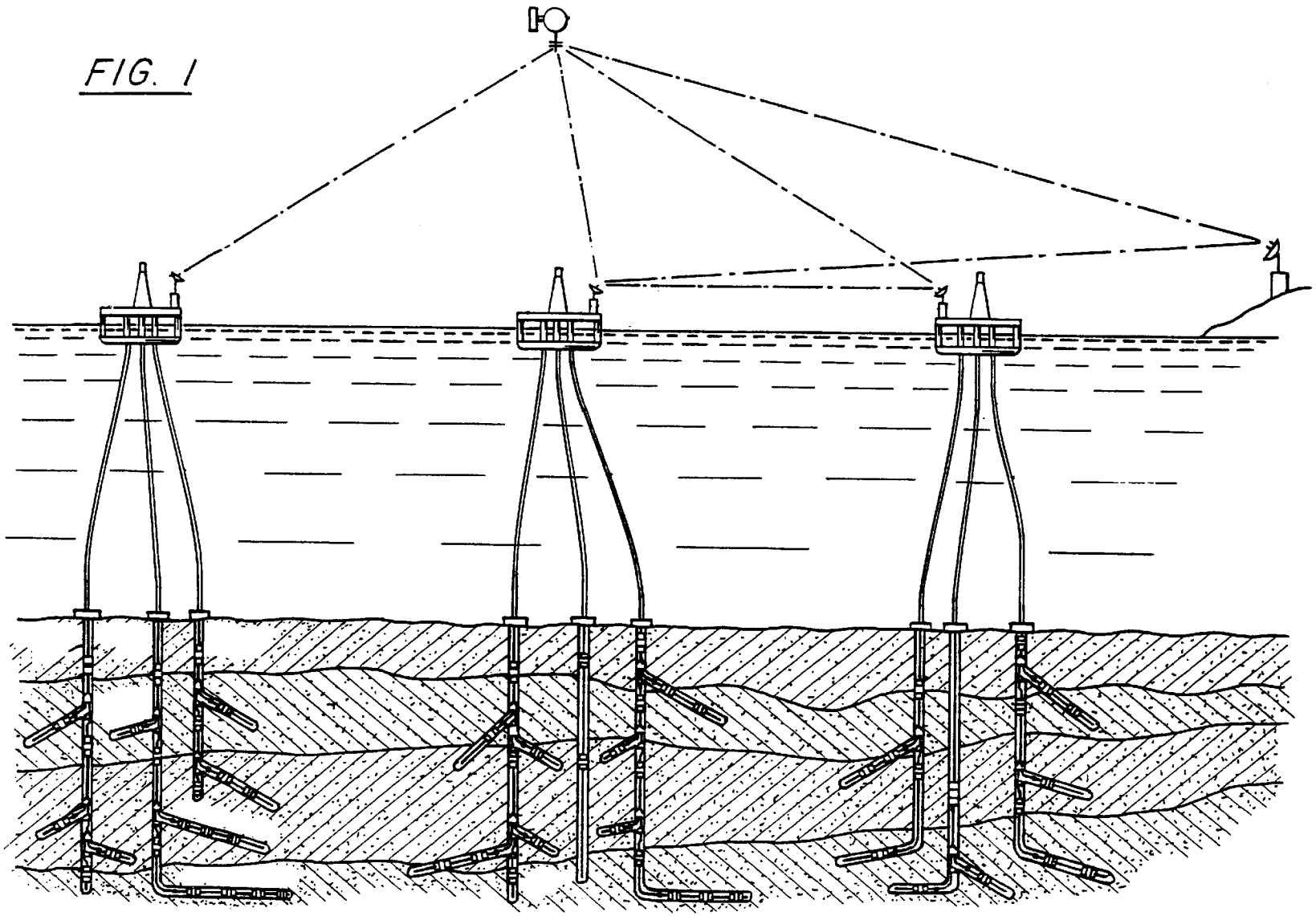
FIG. 1 illustrates communication pathways to other platforms and wells.
Figure 2:
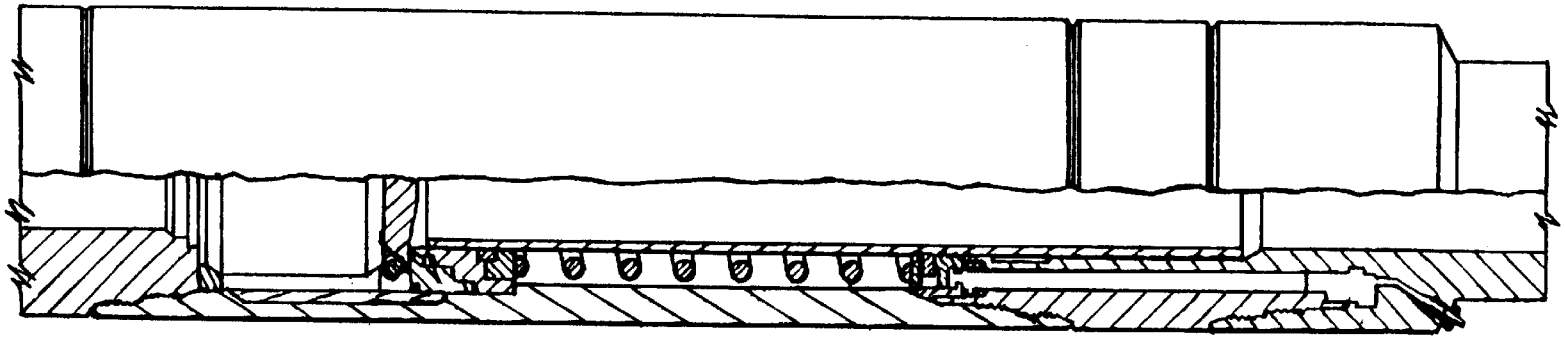
FIG. 2 (PRIOR ART)
FIG. 2 is an illustration of a prior art safety valve.

Referring to FIG. 2, the general operative components of a flapper and flow tube type safety valve are retained in this invention. FIG. 2, therefore, provides a point of reference for the invention, which is preferably of electronic actuation but could be hydraulic or a combination. FIG. 2 is also the basis for building the intelligent system of the invention.

Referring to FIG. 4, one of skill in the art will appreciate the schematic representation indicating communication pathways between various components of the invention. The safety valve assembly is schematically illustrated as 30, the internal sensors being shown therewithin and identified by numeral 32. The invention further includes external or environmental sensors 34 illustrated outside schematic 30 but with communication pathways to internal sensors 32 and to a downhole processor 36 or surface processor 38. Communication capability is also supplied and is indicated by 40. Data storage 42 may be provided either locally or remotely, even over telephone lines or via satellite link.

Figure 3:
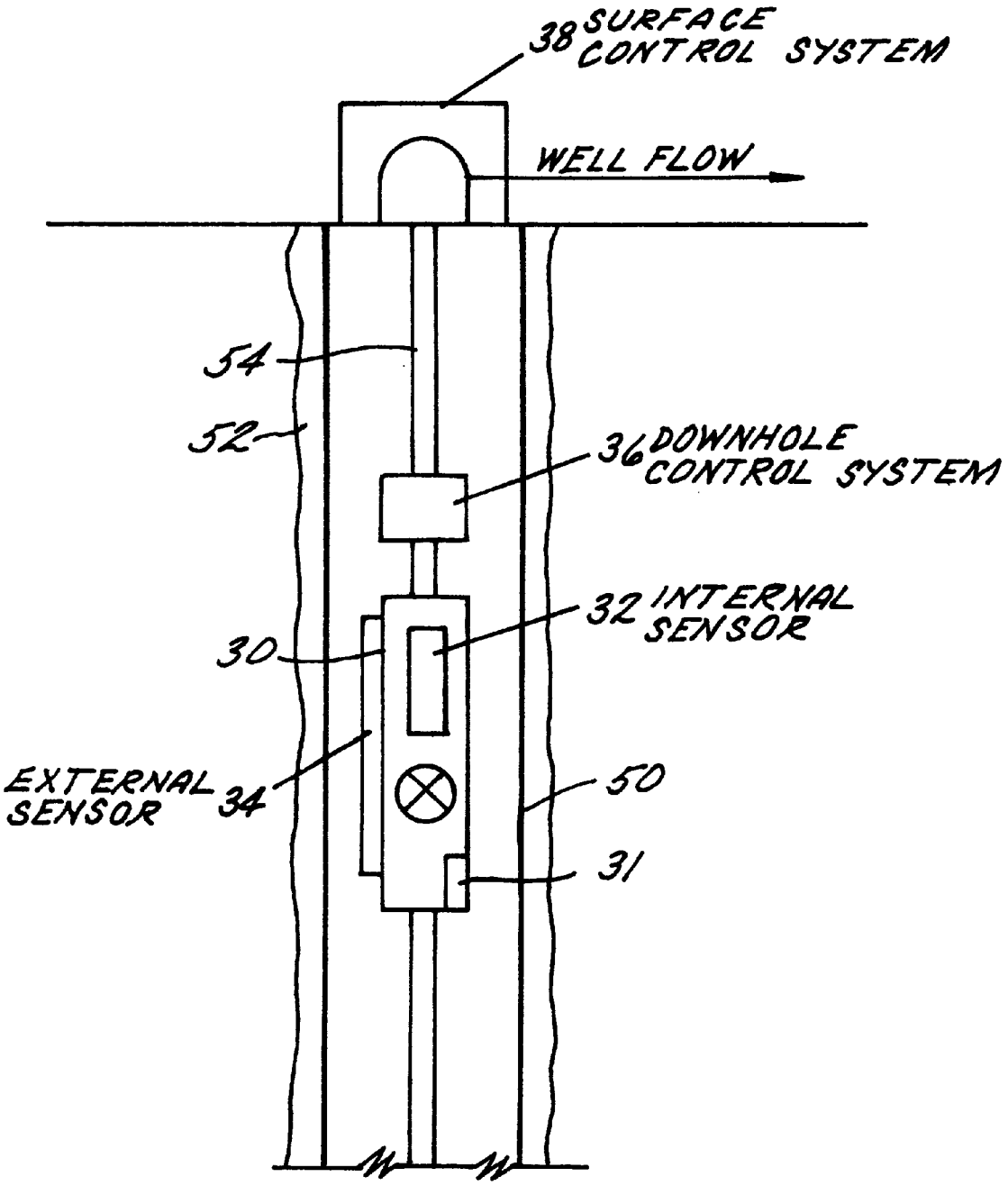
FIG. 3 is a schematic representation of a safety valve of the invention in the downhole environment.

Referring to FIG. 3, a schematic illustration of the invention is provided in order to aid in understanding the general layout of the invention. Numeral 30 identifies the safety valve housing. 32 and 34 identify internal and external sensors, respectively. The downhole controller 36 is illustrated uphole of the valve 30, however, it should be understood that the controller 36 can be located above, below, alongside or even around the valve housing as desired. Surface controller 38 is at the surface of the well. Numeral 31 designates the downhole heater employed to melt and disperse paraffin that builds up over time. One of ordinary skill in the art will recognize casing 50, borehole 52 and production pipe 54.

Employing the intelligent system of the invention, real time information is obtained about conditions of the downhole environment and tools. These include conditions which require closing or opening of the valve and additionally, conditions which indicate anticipated life before failure. Moreover, sensors that accumulate information and communicate that information to a processor also provide information about paraffin, sand, etc., that might accumulate in the safety valve and which potentially can prevent or hinder proper operation thereof. Because of the intelligence in the immediate area of the valve, corrective measures are undertaken without even a direction from the surface operator. Measures such as heating to melt and disperse paraffin or cleaning to remove sand or other solid or viscous build up are actuatable in response to downhole decision making processor(s).

The safety valves of the invention are also failsafe in that they require an impetus from either electrical or hydraulic systems to open against the urging of a spring. Upon loss of power or pressure the spring will close the valve. Such a loss in power or pressure can be due to accident or by design. In the invention, a redundant electrical system for closure of the valve is also provided, preferably, powered by a capacitor or other electrical storage devices. This system will close the valve in the event the spring has scaled and will not operate. In general, a solenoid will be actuated by the capacitor to force the flapper closed.

Internal sensor 32 range in number from one to many and sense flow tube position, flapper position, friction of movement of the flow tube and power required to move it, valve orientation etc. Additionally, sensors obtain information about strength of signal from the electric or hydraulic actuation line. This is compared to the signal placed on that line at the surface to determine whether trouble exists on the line. These sensors provide confirmation of the proper operation of the safety valve and, moreover, allow operators to keep track of the breakdown thereof over time. This provides benefits both to the well operator and to the manufacturer. With respect to the operator, analyzing trends of the valve can help avoid a failure thereof and provide advance warning of a potential failure so that remedial measures can be undertaken before a catastrophic occurrence. From the standpoint of the manufacturer who may have warranted the valve or may be liable for damages caused by a failure, the sensors provide a log of information indicating whether or not the operator was negligent in the control of the valve, the maintenance thereof or in replacement of the same.

Environmental sensors, indicted in FIGS. 3 and 4 at 34, are preferably, a multiplicity of sensors designed to obtain information regarding temperature at the valve, differential pressure across the valve(sense pressure above and below valve and calculate differential), leakage across the valve, annulus pressure, tension and torque at the valve, bending moment on the valve, water contamination, seismic activity etc. A very important aspect of the invention is adaptability of the system in response to information obtained by the sensors and without intervention by an operator. In other words, the intelligent controller analyzes all information collected and is capable of issuing commands to other tools or to safety valve components to change one or more operating parameters to optimize performance of the valve even if time or use had reduced its normal operating capacity. Altered operating parameters can regain lost efficiency in particular conditions. More specifically, where parameters are set for particular conditions and the conditions later change, the ability of the system to compensate is extremely valuable to the well operator.

Information obtained via internal and environmental sensors is used not only for adaptability of the system but is added to a database having preprogrammed information and other periodic additions. The log created hereby assists in trend analysis and also can be employed to help design new tools.

Another important aspect of the invention is the capability of communication between and among sensors, a data storage unit, the surface, other wells or even other platforms. Communicated information from one well to others can help prevent catastrophic occurrences and can avoid unnecessary shut-in of other wells if the reason for shut-in is containable in one well. This intelligent determination and instructions in real time from one well to another is very important to the industry. As one of skill in the art will appreciate, a shut-in well may indicate a serious problem, however, the interests of the operator are to avoid a reduction in production. Therefore, the interests are to increase production from other wells when a shut-in well is detected. This is sometimes appropriate and sometimes dangerous. With the system of the invention, decision making about which actions to take is based upon real time conditions and the communication capability allows the system to alter other wells according to preprogrammed responses so that either a dangerous situation is controlled or production rate is maintained as appropriate. The system also can be overridden from an input device such as a keyboard at the surface, if necessary, so that optimum operation can always be maintained.

The communication system of the invention also provides significant control of other downhole tools based upon real time data as opposed to discovering a problem such as in flow of water at the surface when the entire production tube is contaminated. More specifically, the safety valve through which all fluid entering the system downhole thereof must flow, will detect any such contamination and will communicate with a downhole tool such as, for example, a sliding sleeve in the offending zone and signal a closure of that sleeve. Communication possible with the system of the invention in real time include: the number of times a tool has been actuated; time to actuate each tool and any of the sensory information discussed hereinabove. All of the information will also be stored in memory for comparison purposes.

The entire system of the invention operates in conjunction with a surface safety system which monitors, through communications, all of the processes downhole and provides the capability of the operator to alter actions taken downhole. The communication system is most preferably a single wire with multiplexing extending to the surface. In another embodiment, a pair of communication conduits running to the valve housing are employable. Particular embodiments of the invention follow hereinbelow.

Figure 5:
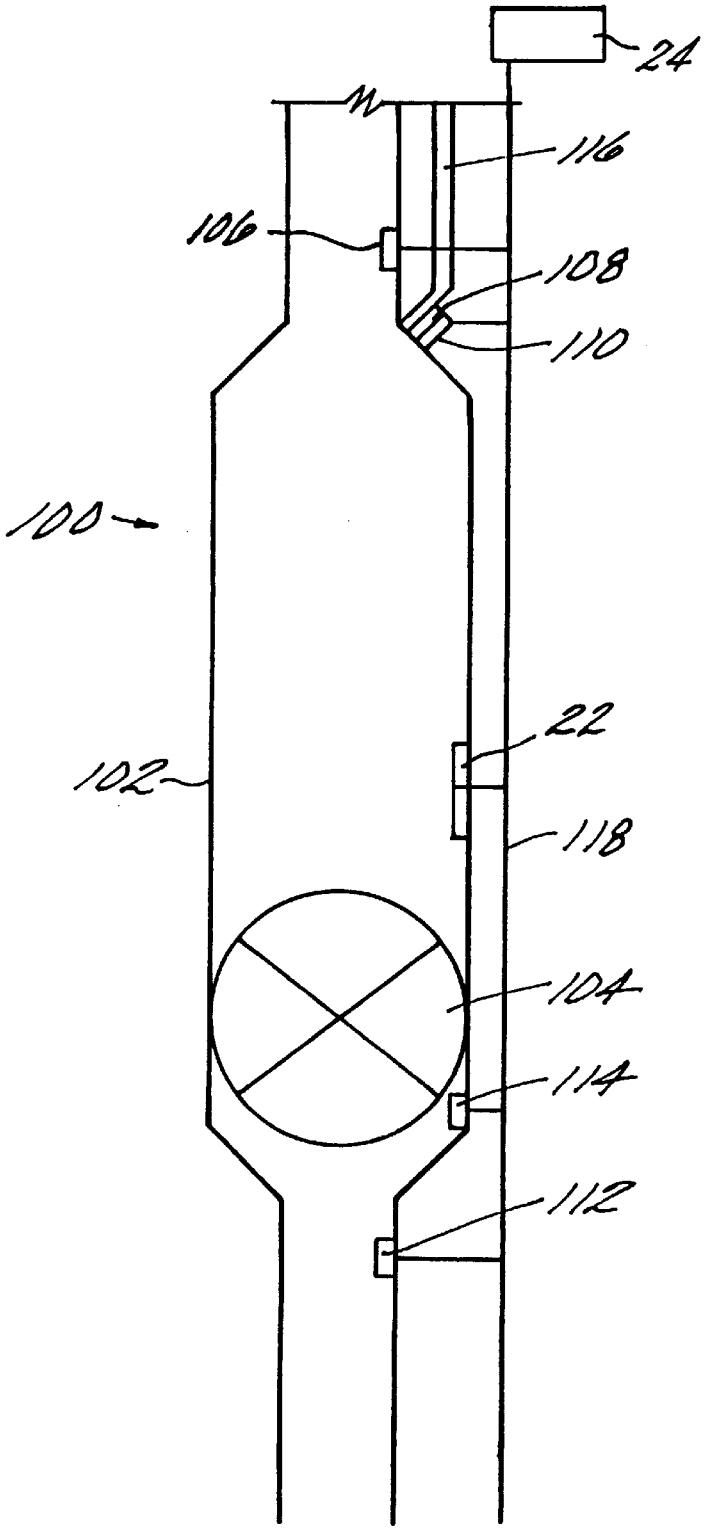
FIG. 5 is a schematic representation of a particular embodiment of the invention.

Referring to FIG. 5, a subsurface safety valve position and pressure monitoring system is shown generally at 100. System 100 includes a valve housing 102 which houses a downhole valve such as a shut-in valve 104. Various pressure and positioning parameters of shut-in valve 104 are determined through the interaction of five sensors which are preferably tied to a single electrical single or multi conductor line (e.g. the aforementioned TEC cable). These five sensors remotely monitor the critical pressures and valve positions relative to safe, reliable remotely controlled subsurface safety valve operations. The downhole sensors include four pressure sensors 106, 108, 110 and 112 and one proximity sensor 114. Pressure sensor or transducer 106 is positioned to sense tubing pressure downstream of shut-in valve 104. Pressure transducer or electrical sensor 108 is positioned to sense the hydraulic controlling pressure from hydraulic control-line 116 or electrical signal of the valve is electrically actuated. Pressure transducer 110 is positioned to sense the annulus pressure at a given depth while pressure transducer 112 is positioned to sense the tubing pressure upstream of valve 104. Proximity sensor 114 may be positioned internal or external to the valve or closure member 104 depending upon the type of sensor and the parameters to be measured as well as the specific geometries and methods of operation of the various sensors employed. The sensors function to enable confirmation of the position of the valve 104. Encoded signals from each of the sensors 106 through 114 are fed back to the surface system 24 or to a downhole module 22 through a power supply/data cable 118 connected to the surface system 24 or downhole module 22. Alternatively, the encoded signals may be transmitted by a wireless mechanism. Preferably cable 118 comprises tubing encapsulated single or multiconductor line (e.g. the aforementioned TEC cable) which is run external to the tubing string downhole and services as a data path between the sensors and the surface control system.

A downhole module 22 may automatically or upon control signals sent from the surface, actuate a downhole control device to open or shut valve 104 based on input from the downhole sensors 104 through 114.

The foregoing subsurface valve position and pressure monitoring system provides many features and advantages relative to prior art devices. For example, the present invention provides a means for absolute remote confirmation of valve position downhole. This is crucial for confident through tubing operations with wireline or other conveyance means and is also crucial for accurate diagnosis of any valve system malfunctions. In addition, the use of the subsurface safety valve position and pressure monitoring system of this invention provides real time surface confirmation of proper pressure conditions for fail-safe operation in all modes. Also, this system provides a means for determination of changes in downhole conditions which could render the safety system inoperative under adverse or disaster conditions and the present invention provides a means for surface confirmation of proper valve equalization prior to reopening after downhole valve closure.

While preferred embodiments have been shown and described, various modifications and substitutions may be made thereto without departing from the spirit and scope of the invention. Accordingly, it is to be understood that the present invention has ben described by way of illustration and not limitation.

What is claimed is:

1. A subsurface safety valve position and monitoring system for a production well comprising:

a downhole valve housing;

a downhole valve housed in said valve housing;

a controller for controlling said downhole valve;

sensors proximate said valve to provide sensory information about the environmental conditions proximate to the valve and the condition of the valve, said sensors transmitting said information to said controller; and a pair of communications conduits running to said valve housing.

2. A subsurface safety valve position and monitoring system for a production well as claimed in claim 1 wherein said downhole valve is electrically operated.

3. A subsurface safety valve position and monitoring system for a production well as claimed in claim 1 wherein said downhole valve is hydraulically operated.

4. A subsurface safety valve position and monitoring system as claimed in claim 1 wherein said system further includes a proximity sensor associated with said downhole valve to sense position of said valve.

5. A subsurface valve position and monitoring system as claimed in claim 1 wherein said sensors include:

a first pressure sensor for sensing pressure upstream of said downhole valve;

a second pressure sensor for sensing pressure downstream of said downhole valve;

a third pressure sensor for sensing pressure at a control line; and a fourth pressure sensor for sensing pressure in an annulus between said valve housing and a wellbore.

6. A subsurface valve position and monitoring system as claimed in claim 5 wherein said plurality of sensors further include; a proximity sensor associated with said downhole valve.

7. A subsurface valve position and monitoring system as claimed in claim 1 further comprising a temperature sensor associated with said downhole valve.

8. A subsurface safety valve position and monitoring system as claimed in claim 1 wherein said controller is located within said valve housing.

9. A subsurface safety valve in an oil well comprising:

a downhole valve housing;

a safety valve housed in said valve housing; and at least one sensor proximate said housing to sense at least one parameter of said valve said parameter being at least one of differential pressure across the valve, leakage across the valve, tension in at least one of the valve and housing, torque on at least one of the valve and housing, bending moment on the valve, contaminants in a produced fluid from the oil well, paraffin buildup on valve components of said safety valve, speed of movement of components of said safety valve, acceleration of components of said safety valve, and position of components and strain on components of said safety valve.

10. A subsurface safety valve in an oil well as claimed in claim 9 wherein said valve is self adjustable.

11. A subsurface safety valve in an oil well as claimed in claims 9 wherein said valve includes a controller, said controller handling decision making and adjustment downhole and without surface intervention.

12. A subsurface safety valve in an oil well as claimed in claim 9 wherein said safety valve includes downhole electronics adapted to modify signals generated by said at least one sensor to reduce conductors necessary for communication and power.

* * * * *